US010168041B2

(12) United States Patent
Dyson et al.

(10) Patent No.: US 10,168,041 B2
(45) Date of Patent: Jan. 1, 2019

(54) LIGHT FIXTURE

(71) Applicant: Dyson Technology Limited, Wiltshire (GB)

(72) Inventors: Jacob Dyson, London (GB); Douglas Andrew Inge, London (GB); Samuel Emrys James, London (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 99 days.

(21) Appl. No.: 15/125,747

(22) PCT Filed: Feb. 27, 2015

(86) PCT No.: PCT/GB2015/050575
§ 371 (c)(1),
(2) Date: Sep. 13, 2016

(87) PCT Pub. No.: WO2015/136241
PCT Pub. Date: Sep. 17, 2015

(65) Prior Publication Data

US 2017/0023228 A1 Jan. 26, 2017

(30) Foreign Application Priority Data

Mar. 14, 2014 (GB) ..... 1404624.7

(51) Int. Cl.
*F21V 29/00* (2015.01)
*F21V 29/71* (2015.01)
(Continued)

(52) U.S. Cl.
CPC ..... *F21V 29/71* (2015.01); *F21S 8/06* (2013.01); *F21V 29/717* (2015.01); *F21V 29/76* (2015.01);
(Continued)

(58) Field of Classification Search
CPC ... F21S 8/06; F21S 8/061; F21S 8/068; F21V 29/503; F21V 29/71; F21V 29/717;
(Continued)

(56) References Cited

U.S. PATENT DOCUMENTS 5,558,155 A 9/1996 Ito
5,901,040 A 5/1999 Cromwell et al.
(Continued)

FOREIGN PATENT DOCUMENTS

CN 201072764 6/2008
CN 201193813 2/2009
(Continued)

OTHER PUBLICATIONS

Search report dated Mar. 11, 2015, directed to GB Application No. 1404624.7; 2 pages.
(Continued)

*Primary Examiner* — Tsion Tumebo
(74) *Attorney, Agent, or Firm* — Morrison & Foerster LLP

(57) ABSTRACT

A light fixture including a light source and heat pipes that are connected to an array of fins which cool the light source. The light fixture is configured such that the thermal mass is minimised local to the light source. The heat pipes are arranged so that they are aligned with the light emitting areas of the light source. The heat pipes and fins form a structure which supports the light source.

28 Claims, 7 Drawing Sheets

(51) Int. Cl.

| | |
|---|---|
| ***F21S 8/06*** | (2006.01) |
| ***F21V 29/76*** | (2015.01) |
| *F21V 29/503* | (2015.01) |
| *F21V 29/85* | (2015.01) |
| *F21V 5/04* | (2006.01) |
| *F21Y 115/10* | (2016.01) |

(52) U.S. Cl.
CPC ..... *F21S 8/061* (2013.01); *F21S 8/068* (2013.01); *F21V 5/04* (2013.01); *F21V 29/503* (2015.01); *F21V 29/763* (2015.01); *F21V 29/85* (2015.01); *F21Y 2115/10* (2016.08)

(58) Field of Classification Search
CPC ..... F21V 29/76; F21V 29/763; F21V 29/85; F21V 5/04; F21Y 2115/10
USPC ..... 362/294
See application file for complete search history.

(56) References Cited

U.S. PATENT DOCUMENTS

| | | | | |
|---|---|---|---|---|
| 7,488,093 | B1 * | 2/2009 | Huang | F21S 8/086 362/294 |
| 7,744,257 | B2 * | 6/2010 | Zhou | F21K 9/00 165/104.33 |
| 7,934,851 | B1 * | 5/2011 | Boissevain | F21S 2/005 362/241 |
| 8,177,397 | B1 | 5/2012 | Knoble et al. | |
| 2006/0092639 | A1 | 5/2006 | Livesay et al. | |
| 2006/0175045 | A1 | 8/2006 | Chen | |
| 2007/0051498 | A1 | 3/2007 | Xia et al. | |
| 2007/0074857 | A1 | 4/2007 | Xia et al. | |
| 2007/0107871 | A1 | 5/2007 | Xia et al. | |
| 2007/0279909 | A1 | 12/2007 | Li | |
| 2008/0007954 | A1 | 1/2008 | Li | |
| 2008/0062694 | A1 * | 3/2008 | Lai | F21V 29/30 362/294 |
| 2008/0175008 | A1 | 7/2008 | Hu et al. | |
| 2009/0027888 | A1 | 1/2009 | Yu et al. | |
| 2009/0034275 | A1 * | 2/2009 | Cheng | F21K 9/00 362/373 |
| 2009/0040760 | A1 | 2/2009 | Chen et al. | |
| 2009/0059604 | A1 * | 3/2009 | Yu | F21K 9/00 362/373 |
| 2009/0095961 | A1 | 4/2009 | Lai | |
| 2009/0116240 | A1 | 5/2009 | Ho | |
| 2009/0147522 | A1 * | 6/2009 | Shuai | F21V 29/004 362/294 |
| 2009/0230834 | A1 | 9/2009 | Liu | |
| 2009/0236626 | A1 | 9/2009 | Xiao et al. | |
| 2009/0237933 | A1 | 9/2009 | Liu | |
| 2009/0260782 | A1 | 10/2009 | Whitney et al. | |
| 2009/0266513 | A1 | 10/2009 | Xiong et al. | |
| 2009/0278460 | A1 | 11/2009 | Chen | |
| 2009/0284972 | A1 | 11/2009 | Chang | |
| 2010/0014299 | A1 | 1/2010 | Qin | |
| 2010/0020553 | A1 | 1/2010 | Teng et al. | |
| 2010/0073933 | A1 | 3/2010 | Scott | |
| 2010/0208460 | A1 | 8/2010 | Ladewig et al. | |
| 2010/0243211 | A1 | 9/2010 | Meyer, IV et al. | |
| 2010/0271819 | A1 | 10/2010 | Kristoffersen et al. | |
| 2010/0314984 | A1 | 12/2010 | Lee | |
| 2011/0073159 | A1 * | 3/2011 | Shen | F21V 29/02 136/246 |
| 2011/0090706 | A1 | 4/2011 | Scott et al. | |
| 2011/0110088 | A1 | 5/2011 | Chen | |
| 2011/0114293 | A1 | 5/2011 | Lin et al. | |
| 2011/0170297 | A1 | 7/2011 | Hockel | |
| 2011/0305020 | A1 | 12/2011 | Wang | |
| 2012/0008329 | A1 * | 1/2012 | Wang | F21V 15/01 362/372 |
| 2012/0063116 | A1 * | 3/2012 | Baxter | F21V 5/045 362/6 |
| 2012/0098400 | A1 | 4/2012 | Yu et al. | |
| 2012/0113641 | A1 | 5/2012 | Scott et al. | |
| 2012/0206927 | A1 | 8/2012 | Miyahara | |
| 2012/0211201 | A1 | 8/2012 | Kunstwadl et al. | |
| 2012/0320589 | A1 | 12/2012 | Wang | |
| 2013/0223063 | A1 | 8/2013 | Lee et al. | |
| 2013/0249374 | A1 | 9/2013 | Le et al. | |
| 2014/0268835 | A1 * | 9/2014 | Rudisill | F21V 21/14 362/391 |

FOREIGN PATENT DOCUMENTS

| | | |
|---|---|---|
| CN | 101392900 | 3/2009 |
| CN | 201206818 | 3/2009 |
| CN | 201218484 | 4/2009 |
| CN | 201277526 | 7/2009 |
| CN | 201344506 | 11/2009 |
| CN | 201382345 | 1/2010 |
| CN | 201475752 | 5/2010 |
| CN | 201555083 | 8/2010 |
| CN | 201575378 | 9/2010 |
| CN | 101852378 | 10/2010 |
| CN | 201651989 | 11/2010 |
| CN | 201663782 | 12/2010 |
| CN | 201688174 | 12/2010 |
| CN | 201754049 | 3/2011 |
| CN | 201772413 | 3/2011 |
| CN | 201803157 | 4/2011 |
| CN | 201844244 | 5/2011 |
| CN | 201992498 | 9/2011 |
| CN | 202158444 | 3/2012 |
| CN | 102683571 | 9/2012 |
| CN | 202421709 | 9/2012 |
| CN | 202757095 | 2/2013 |
| CN | 203082845 | 7/2013 |
| CN | 203533494 | 4/2014 |
| CN | 203703903 | 7/2014 |
| DE | 20 2010 005 951 | 9/2010 |
| DE | 20 2011 051 455 | 11/2011 |
| GB | 2459981 | 11/2009 |
| JP | 51-54 | 1/1976 |
| JP | 4-282857 | 10/1992 |
| JP | 2002-246521 | 8/2002 |
| JP | 2004-69234 | 3/2004 |
| JP | 2008-78171 | 4/2008 |
| JP | 2010-34033 | 2/2010 |
| JP | 2015-111497 | 6/2015 |
| TW | M399262 | 3/2011 |
| TW | 201142193 | 12/2011 |
| TW | 201200790 | 1/2012 |
| TW | 201217694 | 5/2012 |
| TW | 201250196 | 12/2012 |
| TW | M479388 | 6/2014 |
| WO | WO-2011/032554 | 3/2011 |
| WO | WO-2011/055659 | 5/2011 |
| WO | WO-2013/145049 | 10/2013 |

OTHER PUBLICATIONS

International Search Report and Written Opinion dated Apr. 8, 2015, directed to International Application No. PCT/GB2015/050575; 9 pages.

* cited by examiner

LIGHT FIXTURE

REFERENCE TO RELATED APPLICATIONS

This application is a national stage application under 35 U.S.C. 371 of International Application No. PCT/GB2015/050575, filed Feb. 27, 2015, which claims the priority of United Kingdom Application No. 1404624.7, filed Mar. 14, 2014, the entire contents of which are hereby incorporated by reference.

FIELD OF THE INVENTION

The invention relates to a light fixture. In a preferred embodiment, the invention relates to a light fixture comprising high-brightness light emitting diodes (LEDs), and the passive cooling thereof.

BACKGROUND OF THE INVENTION

In recent years the use of LEDs in consumer lighting devices has significantly increased as a consequence of the potential for increased service life and increased energy efficiency over conventional fluorescent and incandescent bulbs. In comparison to these types of bulbs, however, a significant amount of heat is produced by LEDs. This heat, if not removed from the LED, will increase the junction temperature, i.e. the temperature at which the LED operates. This has deleterious effects on the efficiency and service life of the LED, as well as the consistency over time of the colour of the light output from the LED. Accordingly, it is important to reduce the junction temperature of the LED as much as possible by removing heat from the LED in operation.

In particular, high brightness LED arrays can be manufactured which include over a hundred LED die in a single package with a light emitting area of only a few $cm^2$. While this small light emitting surface area is highly beneficial in terms of the uniformity of the emitted light, it results in a high amount of heat production, concentrated to a small area, which can result in a rapid increase in junction temperature if not suitably managed.

It is well known in the art to use heat-sinks formed of thermally conducting materials such as aluminium, copper or other metals. Generally, an LED might be mounted on a solid block, from which extends a plurality of fins. These increase the surface area of the heat-sink to allow more heat to be dissipated into the surrounding air by convection. For high-brightness LEDs where the heat output may be in excess of tens of Watts, forced air cooling is often used, wherein fans, piezoelectric microblowers or similar are used to increase airflow over the heat-sink. However, the inclusion of these components in a lighting fixture will increases its cost, complexity and power consumption. Furthermore, the inclusion of such components will increase the noise contamination caused by the fixture and increase the fixture's maintenance requirements.

It is also known in the art to create more complex passive cooling circuits which combine multiple heat-sinks by means of heat pipe technology. For example, WO 2011/032554 A1 is directed towards a cooling device for a heat source, especially LED modules, wherein the LED module is connected to a first heat-sink which comprises a main metal block from which fins extend. This first heat-sink is thermally connected to a second, larger heat-sink by means of heat pipes running through the main block of the first heat-sink.

Fundamentally, however, the removal of heat from the LED module in cooling circuits such as this is limited by the first heat-sink. In particular, any inefficiencies in the transfer of heat from the LED module to the first heat-sink can act as a 'thermal bottleneck', resulting in an increase in the junction temperature.

The present invention aims to ameliorate these and other deficiencies of the prior art.

SUMMARY OF THE INVENTION

According to one aspect of the present invention there is provided a lighting device comprising a light source, at least one heat pipe thermally connected to the light source and extending away from the light source, and heat exchanging means which are remote from the light source and are thermally connected to the at least one heat pipe so that heat is transferred from the light source to the heat exchanging means by the at least one heat pipe, and dissipated from the heat exchanging means through convection, wherein the lighting device is adapted such that thermal mass is minimised local to the light source and that the thermal path between the light source and the at least one heat pipes is minimised.

The lighting device may comprise a plurality of heat pipes. The lighting device may further comprise a structure formed of the heat pipes and heat exchanging means, which structure supports the light source. The plurality of heat pipes are in mechanical and thermal contact with each other local to the light source. The light source may have a light emitting side and a thermally conducting side which is in thermal communication with the heat pipes; and the heat pipes may be in substantial alignment with the areas of the thermally conducting side which correspond with the light emitting areas of the light emitting side.

According to another aspect of the present invention there is provided a lighting device comprising a light source having a light emitting side and a thermally conducting side, and a plurality of heat pipes in mechanical and thermal contact with each other local to the light source, and extending away from the light source, wherein the heat pipes are in thermal communication with the thermally conducting side of the light source and in substantial alignment with the areas of the thermally conducting side which correspond with the light emitting areas of the light emitting side.

The lighting device may be adapted such that thermal mass is minimised local to the light source and that the thermal path between the light source and the heat pipes is minimised. The lighting device may further comprise heat exchanging means which are thermally connected to the heat pipes and are remote from the light source. The lighting device may further comprise a structure formed of the heat pipes and heat exchanging means, which structure supports the light source.

According to yet another aspect of the present invention there is provided a lighting device comprising a light source, a plurality of heat pipes thermally connected to the light source, heat exchanging means thermally connected to the heat pipes, and a structure formed of the heat pipes and heat exchanging means, which structure supports the light source.

The lighting device may be adapted such that thermal mass is minimised local to the light source and that the thermal path between the light source and the heat pipes is minimised. The light source may have a light emitting side and a thermally conducting side which is in thermal communication with the heat pipes; and the heat pipes may be in substantial alignment with the areas of the thermally conducting side which correspond with the light emitting areas of the light emitting side.

The entirety of the areas of the thermally conducting side of the light source which correspond with the light emitting areas of the light emitting side may be in alignment with the heat pipes.

The heat pipes may form an array, with each heat pipe in direct thermal contact with the adjacent heat pipe to form an area which is at least the same as the area encompassing the light emitting area of the light source.

The light source may be in only in thermal communication with heat exchanging means by the at least one heat pipe.

The heat pipes may be adapted to provide a substantially planar mounting surface.

The heat pipes may be bonded together and the bonded heat pipes may be adapted to provide a continuous, substantially planar, mounting surface.

The heat pipes may support the light source.

The heat exchanging means may comprise a plurality of substantially planar fins.

The lighting device may comprise a thermally conducting plate which connects the light source to the heat pipes.

The lighting device may comprise a support frame. The support frame; heat pipes and heat exchanging means may form a structural assembly.

The light fixture may comprise a lens and/or a baffle. The support frame may support the lens and/or the baffle.

The frame may comprise elongate members which connect to the edges of the heat exchanging means or to the corners of the heat exchanging means. The elongate members may be adapted to engage with corresponding means provided on the heat exchanging means.

The frame may further comprise at least one cross-supporting member which is substantially perpendicular to the edge members. These may comprise means for connecting which are adapted to correspond to and engage with the inward facing profile of the elongate members.

At least one cross supporting member may comprise a substantially planar portion which covers the part of the at least one heat pipe which corresponds to the light source.

Each fin of the heat exchange means may comprise an engagement means, engageable with a corresponding engagement means on an adjacent fin. The engagement means may be a tab which is adapted to receive, and engage with, the tab of an adjacent fin. The tab may comprise an edge profile engageable with a corresponding edge profile on the tab of the adjacent fin. The engagement means may be disposed on at least one corner of the fin.

The means for connecting may be further adapted to connect to a support structure.

The light source may be located at one end of each of the heat pipes.

Preferably, the ratio of the spacing between fins to the height of the fins may be between 1:13 and 1:3.2. Even more preferably, the ratio of the spacing between fins to the height of the fins may be around 1:5.5. The height of the fins may be around 4.5 cm.

Where the lighting device comprises more than one heat pipe, at least some of the heat pipes may bend away from the axis along which they initially extend from the light source and bend back towards the axis along which they initially extend, such that they extend through the heat exchanging means parallel to each other and parallel to the axis along which they initially extend.

The heat exchanging means may be formed of a different material to the heat pipes. The heat exchanging means may be formed of a different material to the mounting plate.

The lighting device may be adapted to be suspended in a space, with the heat exchanging means exposed to the air of the space in which the lighting device is suspended. The lighting device may comprise supporting means adapted to connect to cables from which the lighting device is suspended. The supporting means may be attached to the heat pipes, the heat exchanging means or the support frame.

The light source may comprise one or more LED or one or more LED array. The light source may comprise one or more OLED or one or more OLED array. The light source may comprise one or more laser diode or laser diode array.

BRIEF DESCRIPTION OF THE DRAWINGS

By way of example, embodiments of a lighting fixture according to the invention will now be described with reference to the accompanying drawings.

DETAILED DESCRIPTION OF THE INVENTION

Figure 1:
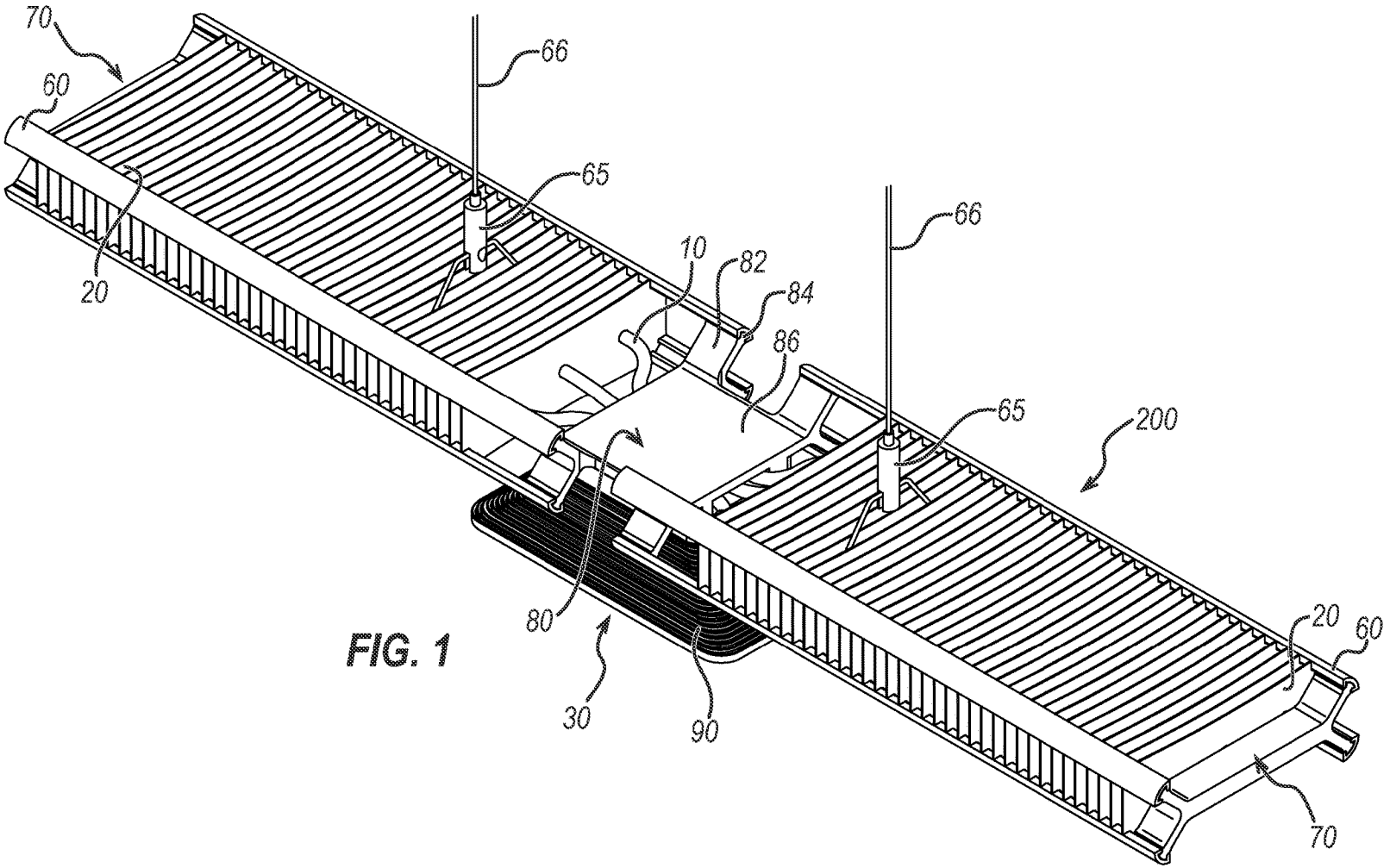
FIG. 1 shows a perspective view of the complete lighting fixture.

FIG. 1 shows a light fixture 200 according to an exemplary embodiment of the present invention. The light fixture 200 comprises a light source 30, which is connected to a cooling circuit 100 comprising heat pipes 10 and fins 20. The cooling circuit 100 is surrounded by a support frame comprised of elongate struts 60, end pieces 70 and central supporting piece 80.

In this embodiment the light source 30 comprises a single high density, high brightness LED array, specifically the Cree® CXA3050 LED array. The LED array comprises a plurality of individual LEDs in a small area to form a single, high brightness, light emitting surface. The array is disposed on a ceramic substrate which is both electrically insulating and has high thermal conductivity.

While here the light source 30 comprises a high brightness LED array, it will be apparent to the skilled person that other light sources may be used. For example, single or multiple high-brightness LEDs, multiple LED arrays, single or multiple OLEDs or OLED arrays, or single or multiple laser diodes or laser diode arrays, are all contemplated.

Figure 2:
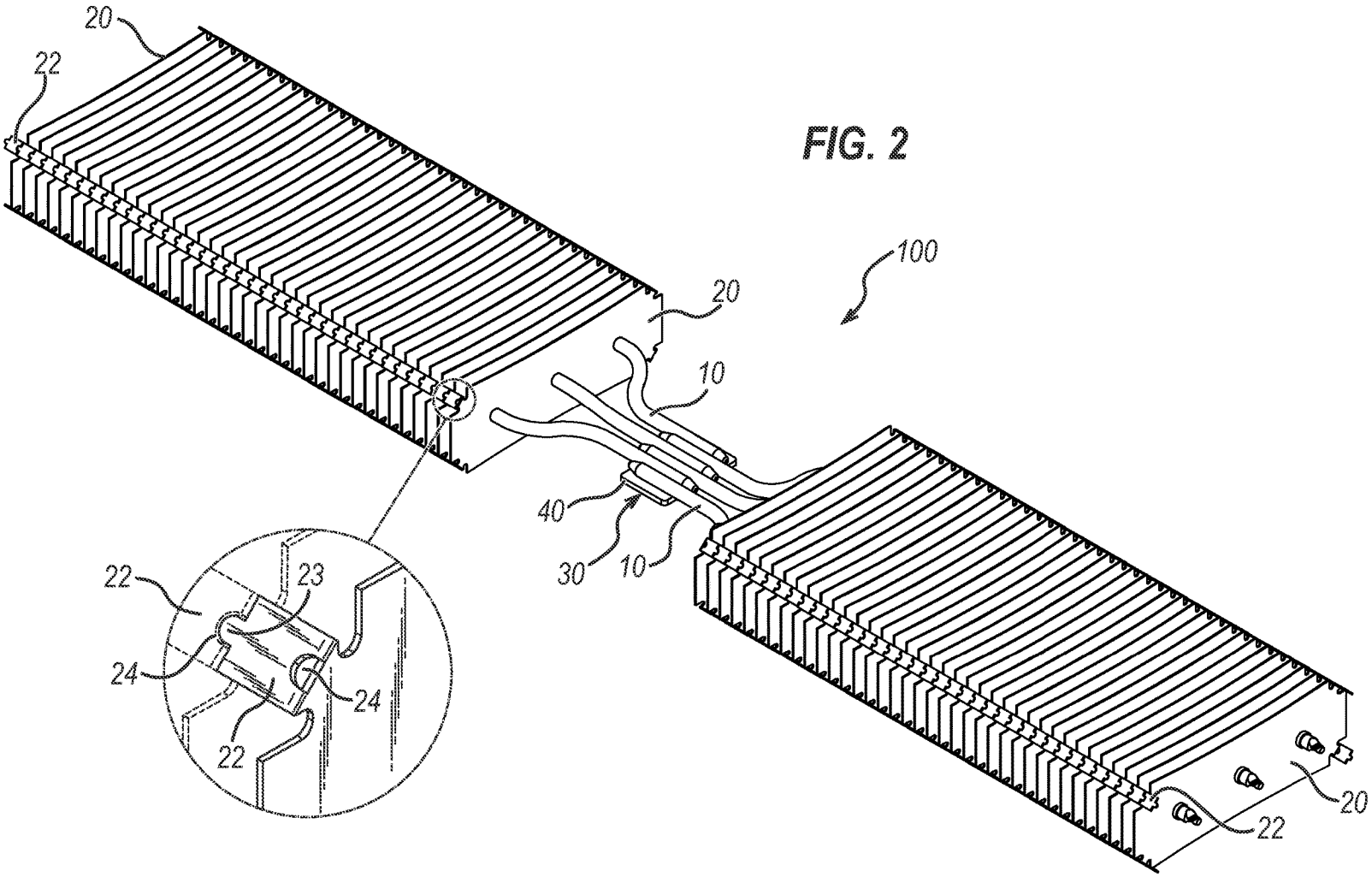
FIG. 2 shows a perspective view of the LED array and cooling circuit of the lighting fixture.

As the high-brightness LED array produces waste heat up to and in excess of 70 W, efficient cooling of the LED array is required to avoid a build-up of heat in the LED array, and corresponding increase in the junction temperature. The light source 30 is cooled by way of the cooling circuit 100. FIG. 2 shows the cooling circuit 100 in isolation. The cooling circuit 100 comprises heat pipes 10 and fins 20. The heat pipes are provided to absorb heat from the light source 30, carry heat away from the light source 30, and transfer the heat to fins 20 which provide a large surface area from which the heat can be convectively dissipated into the surrounding air.

Each heat pipe 10 functions to transfer heat efficiently and evenly away from the light source 30, and to the fins 20. Heat pipes generally have effective thermal conductivities in the range of from 5000 to 200,000 W/mK. Heat pipes comprises a hollow, vacuum tight, sealed tubular structure which contains a small quantity of a working fluid and which has a capillary wicking structure (not shown) in its interior. Heat from the light source 30 is absorbed by vapourising the working fluid. The vapour then transports heat along the heat pipe 10 away from the light source 30 to a region where the condensed vapour releases heat to the fins 20. The condensed working fluid then returns to the end of the heat pipe 10 closest to the light source 30 by means of the wicking structure. In this embodiment, the heat pipes 10 are formed of copper, although any heat pipe of suitably high thermal conductivity may be used.

Figure 6:
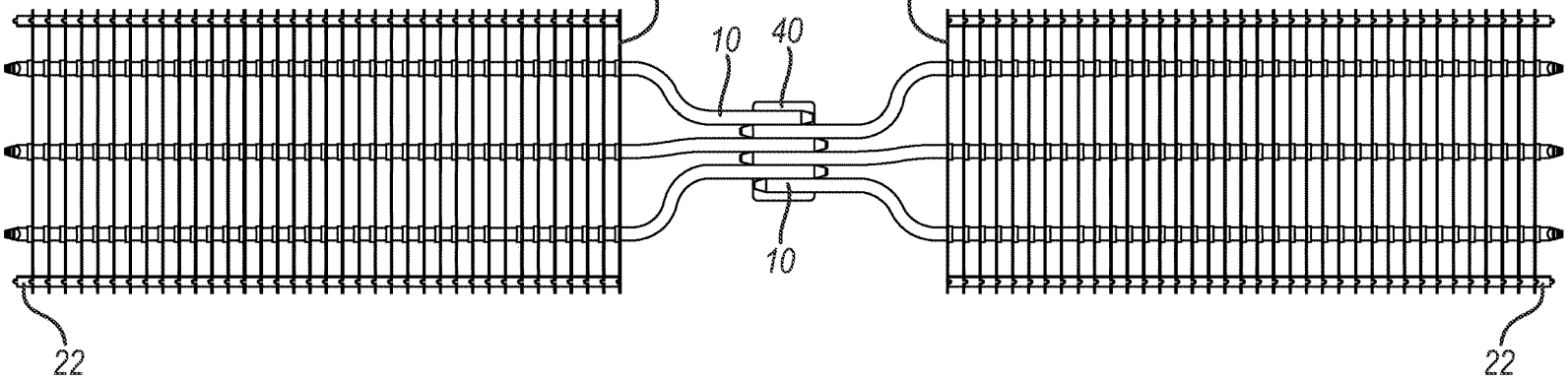
FIG. 6 shows a plan view of the LED and cooling circuit of the lighting fixture.

As shown in FIGS. 2 and 6, each heat pipe 10 is in thermal contact with the light source 30 at one end. The heat pipes 10 extend away from the light source 30 and are mechanically and thermally connected to the fins 20, which are remote from the light source 30. In this embodiment, six heat pipes 10 are provided, but other numbers of heat pipes 10 may be provided depending on the heat dissipation required for a particular light source 30.

Figure 3:
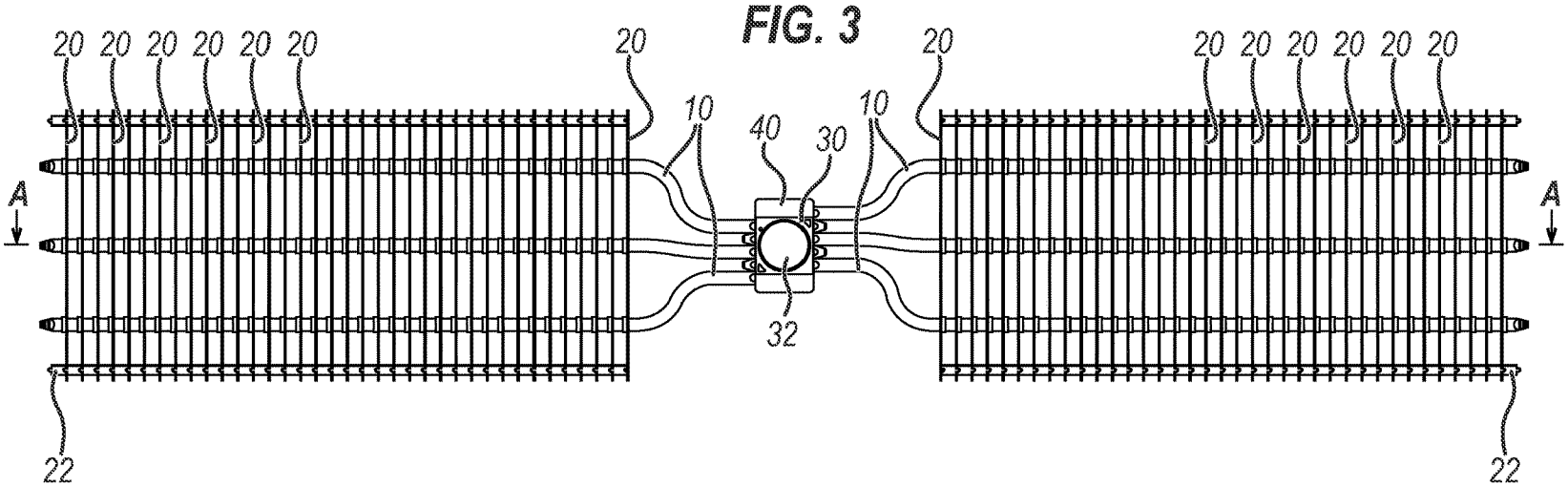
FIG. 3 shows a view of the underside of the LED array and cooling circuit of the lighting fixture.

FIG. 3 shows the underside of the cooling circuit 100, to which the light source 30 is attached. As discussed above, in this case, light source 30 is a high-brightness LED array disposed on a ceramic substrate. This is mounted on the heat pipes 10 by means of a thin thermally conductive mounting plate 40. As shown best in FIGS. 3 and 6, at the light source 30, the heat pipes 10 are parallel and in mechanical and thermal contact with each other. This enables the heat pipes 10 to be in the closest proximity possible to the light source 30. Also, this means that the entire light emitting surface 32 of light source 30 is covered on the reverse side of the light source 30 by at least one of the heat pipes 10. As the heat generation will be localised to the light-emitting surface 32, this arrangement enables the maximum amount of heat to be extracted from the light source 30, as the thermal path between the light emitting surface 32 and the heat pipes 10 is minimised.

The heat pipes 10 are coupled to a plurality of fins 20, which are substantially perpendicular to each other, and are remote from the light source 30. As can be seen in FIGS. 2, 3 and 6, the heat pipes 10 initially bend away from each other, before bending back to extend parallel to each other through the fins 20. In this way, the heat pipes 10 are located evenly along the width of the fins 20, which results in an even dissipation of heat from the heat pipes 10 to the fins 20.

Figure 4:
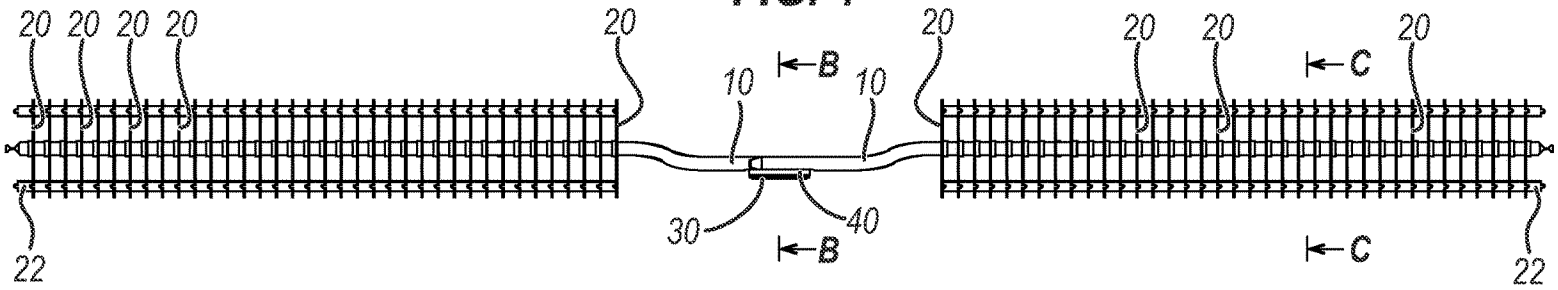
FIG. 4 shows a side view of the LED array and cooling circuit of the lighting fixture.
Figure 5A:
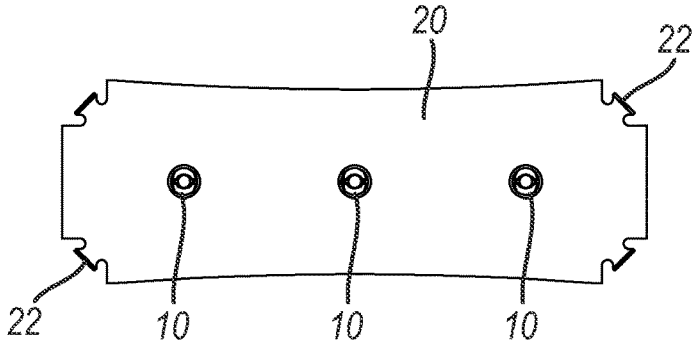
FIG. 5*a* shows an end-on view of the LED array and cooling circuit of the lighting fixture.
Figure 5B:
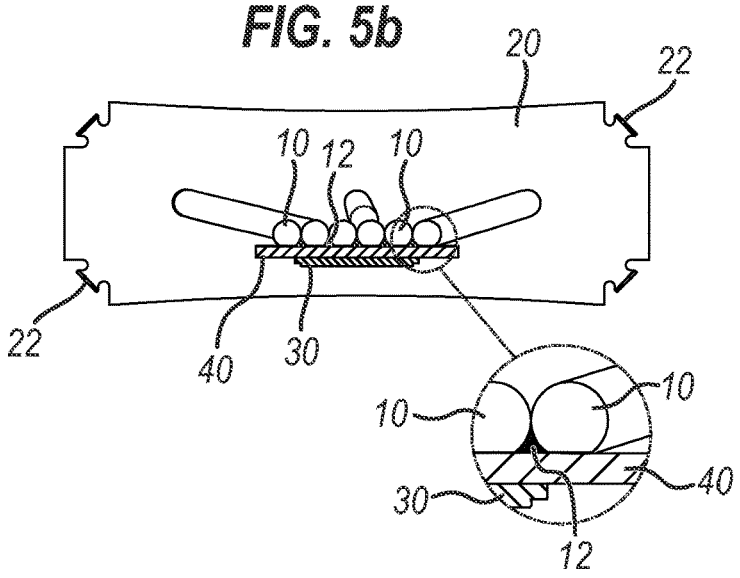
FIGS. 5*b* and 5*c* show cross-sectional views of the LED array and cooling circuit of the lighting fixture through axes B-B and C-C of FIG. 7, respectively.
Figure 5C:
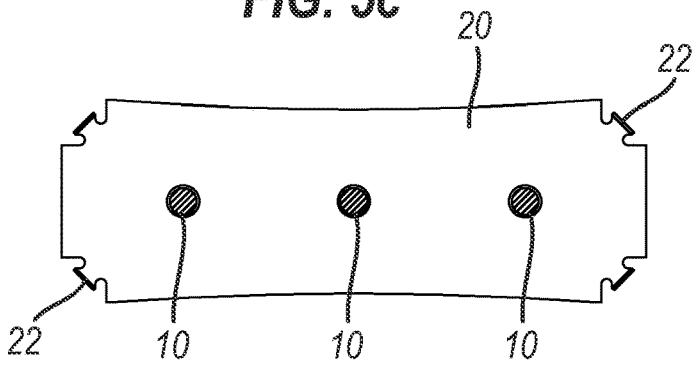

FIG. 5*b* shows a cross-section taken through B-B of FIG. 4, i.e. through the centre of the cooling circuit 100. It can be seen from this view that the heat pipes 10 have been flattened slightly on one side to increase the contact area of the heat pipes. As mentioned above, in this embodiment, the light source 30 is mounted on the heat pipes 10 by means of the mounting plate 40, which in this embodiment is formed of copper and provides thermal contact between the heat pipes 10 and the light source 30, as well as a flat mounting surface for the light source 30. This is important as the high brightness LED array comprises a ceramic substrate. While ceramics offer suitably high thermal conductivity along with electrical insulation, they are generally more brittle than metals. As such, they are liable to mechanical damage if mounted on a non-flat surface. While the sides of the heat pipes 10 have been substantially flattened, they may not provide a sufficiently flat surface for a robust mechanical and thermal connection were the light source 30 mounted directly onto the heat pipes 10. Therefore, the conducting mounting plate 40 is provided, which has a flat surface on which the light source is mounted, but is more malleable and so provides a firm mechanical contact with the heat pipes 10, all the while having high thermal conductivity to facilitate transfer of heat from the light source 30 to the heat pipe 10.

Preferably, as shown in the enlarged section of FIG. 5*b*, the gaps 12 between the curved surfaces of the heat pipes 10 and the mounting plate 40 are filled with a thermally conducting material. For example, solder can be used at gaps 12 to not only bond the heat pipes 10 together, but also ensure that a continuous thermal contact with the mounting plate 40 is provided across the width of the arrangement of heat pipes 10. Of course, continuous thermal contact could also be achieved with a profiled upper surface on mounting plate 40, or alternatively with heat pipes 10 having a cross-section with a substantially 'squared-off' lower portion, so that the size of gaps 12 is negligible.

As can be seen in FIG. 5*b*, the thickness of the mounting plate 40 is significantly less than that of the heat pipes 10 themselves. The thickness of the mounting plate 40 is minimised, so as to reduce the thermal path between the light source 30 and the heat pipes 10 to a minimum, while still providing a firm mechanical and thermal contact between the light source 30 and the heat pipes 10. This maximises the efficiency of heat extraction from the light source 30 by the heat pipes 10.

While in this embodiment, the mounting plate 40 is made of copper, it will be apparent to one skilled in the art that a number of thermally conductive materials would also be suitable. As mentioned above, the light source 30 may alternatively be mounted directly on the heat pipes, dependent on the mechanical and thermal connection required for a particular light source 30.

The heat pipes 10 are directly mechanically and thermally connected to a plurality of fins 20. As best shown by FIGS. 2, 3 and 4, the fins are remote from the light source 30 and are arranged, parallel to each other, along the length of, and perpendicular to, the heat pipes 10. In this embodiment, three of the six heat pipes 10 extend along the axis A-A in one direction away from the light source, and are connected to a first array of fins 20, while the other three heat pipes 10 extend away from the light source in the opposite direction along axis A-A and are connected to a second array of fins 20.

As best shown by FIG. 6, the direction in which the heat pipes 10 extend alternates, i.e. each heat pipe 10 extends in the opposite direction to the adjacent heat pipe 10. This ensures that an equal amount of heat is transferred from the light source 30 to each array of fins 20.

Each fin 20 is substantially planar. In this embodiment the fins 20 are substantially rectangular, though this not necessarily be the case. In this particular embodiment, the fins 20 are dimensioned with a width of 13 cm and a height of 4.5 cm, i.e. the aspect ratio of the fin 20 is about 1:3, corresponding to the three heat pipes 10 which are located evenly along the width of the fin 20, and centrally located vertically on the fin 20. As such, each heat pipe 10 is associated with a roughly equal surface area of the fin 20. It will be appreciated that the dimensions of the fin 20 and the total number of fins 20 provided may be different than in this particular embodiment, depending on the number of heat pipes, and the total surface area required to dissipate heat by convection into the air surrounding the cooling circuit 100.

The fins 20 also comprise integral tabs 22 disposed at each corner of the fin 20. As best shown in the enlarged view in FIG. 2, each tab comprises a protrusion 23 and recess 24. The protrusion 23 of each tab 22 is received by the recess 24 of the corresponding tab 22 of the adjacent fin 20, with the edge of protrusion 23 abutting the edge of the recess 24. In this way, each fin 20 of an array is mechanically located relative to the adjacent fins 20, which increases the mechanical stability of the array as a whole and ensures that the fins 20 remain perpendicular to each other. As the tabs 22 are disposed on the corners of the fins 20, rather than on the surface of the fins 20, obstruction to the airflow between the fins 20 can be avoided, increasing the efficiency of convection through the fin array. Furthermore, this results in a less obstructed view through the fin arrays increases the aesthetic appeal of the light fixture 200.

Due to the high thermal conductivity of the mounting plate 40 and heat pipes 10, the connection between the fins 20 at the integral tabs 22 has negligible impact on the operation of the cooling circuit 100.

In this embodiment the fins 20 are formed of aluminium. While aluminium has a reduced thermal conductivity compared to copper, it has significantly lower density, reducing the overall weight of the light fixture 200. It will be apparent to the skilled person that the fins may alternatively be formed of other suitable materials having sufficiently high thermal conductivity and low weight. For example other metals such as titanium or nickel alloys may be suitable, or indeed non-metallic materials including graphite or other high thermal conductivity carbon based materials. The fins 20 might also be made of a combination of materials.

Returning now to FIG. 1, in the assembled light fixture 200 the cooling circuit 100 is surrounded by a support frame. This is provided to increase the mechanical stability of the light fixture 200, and support a lens 95 and baffle 90 to direct the light emitted from the light source 30. Importantly, air flow between the fins 20 is not obstructed by the support frame, maximising the convection of heat from the fins 20 into the surrounding air. The support frame may be made of any suitable material, for example metals such as aluminium or thermally insulating materials such as plastics. Similarly to the integral tabs 22 of the fins 20, while the support frame connects to and forms a structure with the fins, it has negligible impact on the operation of the cooling circuit 100 due to the high thermal conductivity of the mounting plate 40 and heat pipes 10.

The support frame comprises edge struts 60, end support pieces 70 and central support piece 80.

Figure 7:
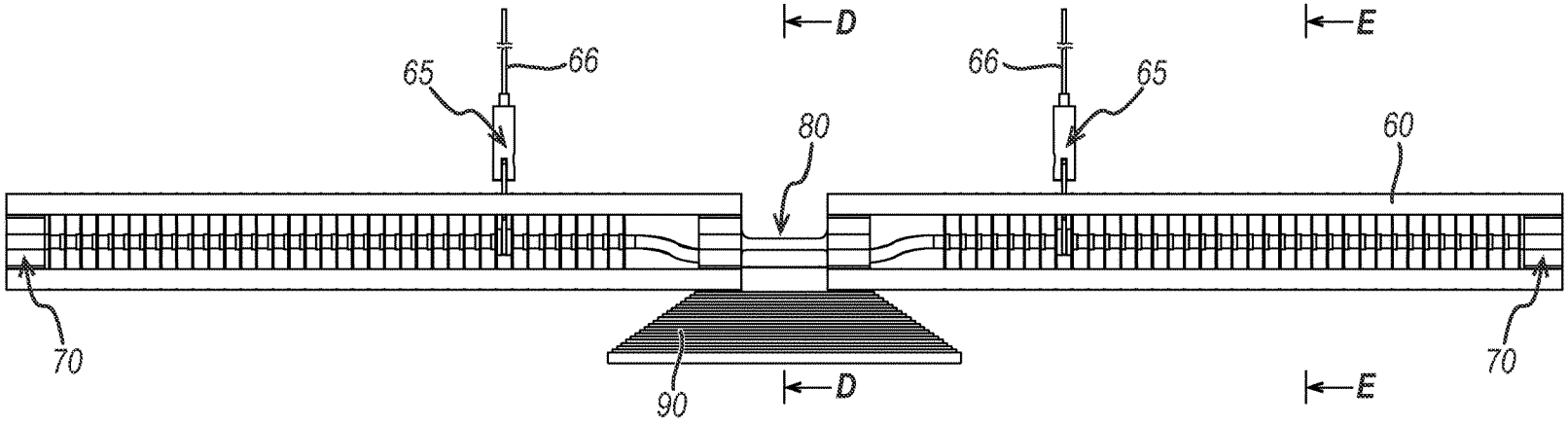
FIG. 7 shows a side view of the complete lighting fixture.
Figure 8B:
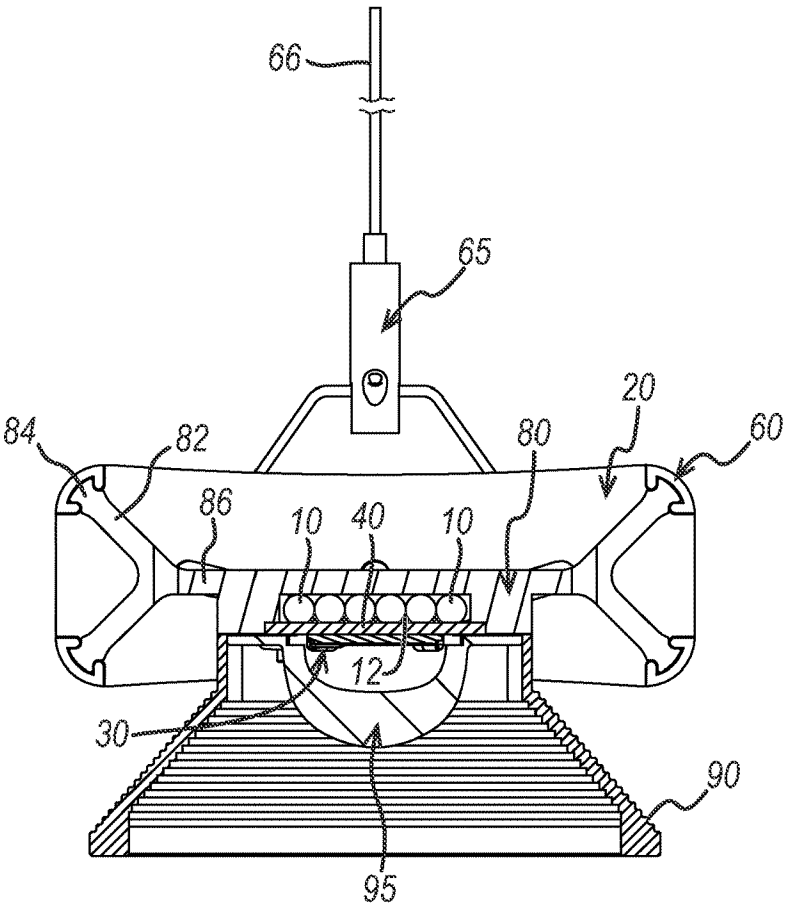
FIGS. 8*b* and 8*c* show cross-sectional views of the complete lighting fixture through axes D-D and E-E of FIG. 7, respectively.
Figure 8A:
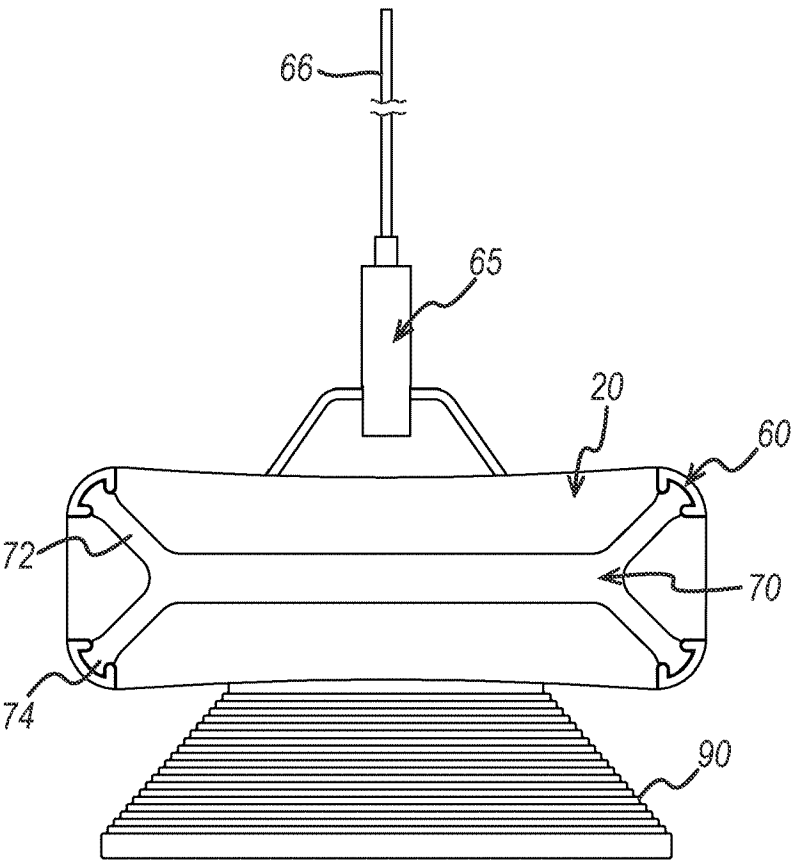
FIG. 8*a* shows an end view of the assembled light.
Figure 8C:
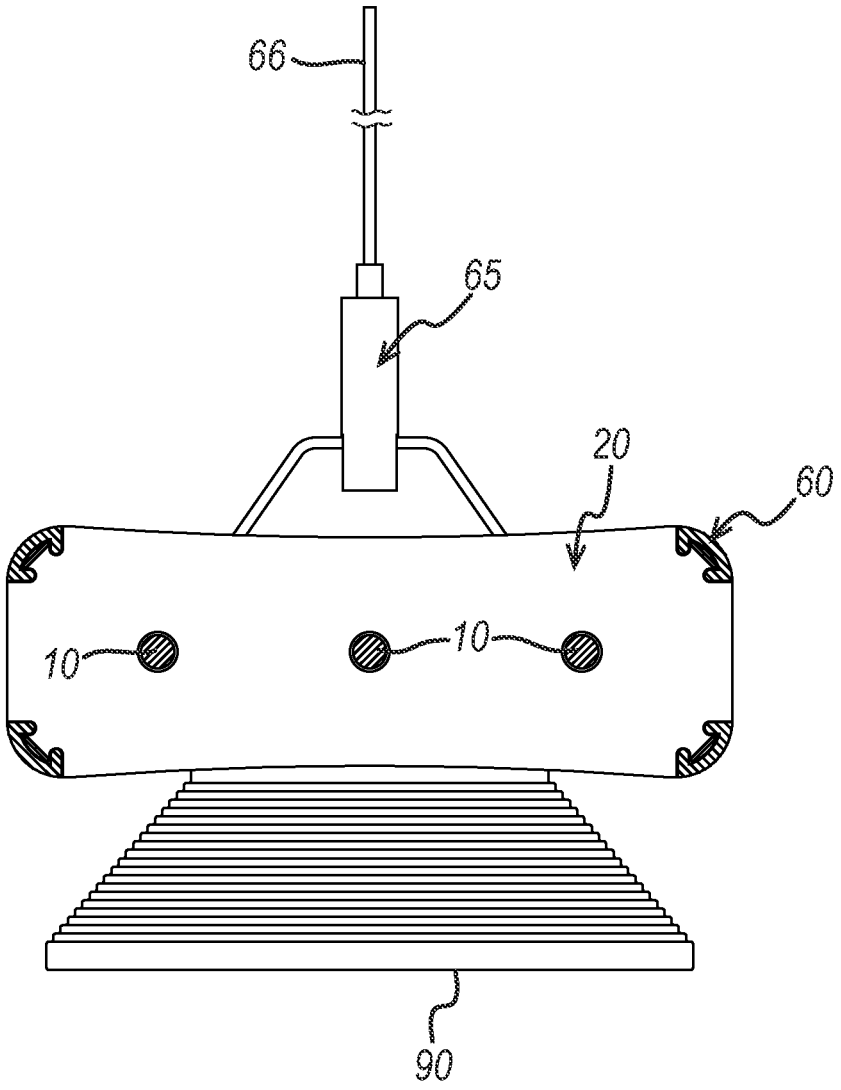

As best shown in FIGS. 8*c* and 1, the cross-section of the edge struts 60 are adapted to correspond to the indentations formed by the tabs 22 at the corners of the fins 20. The edge struts 60 similarly connect to the end support pieces 70 and central support piece 80. As best shown in FIG. 7, the end support piece 70 comprises arms 72. The ends of the arms 74 are shaped to interlock with the inward facing side of the edge struts 60.

Similarly, as best shown in FIGS. 8*b* and 1, the central support piece 80 also comprises arms 82 with ends 84 adapted to interlock with the inward facing side of edge struts 60. The central support piece 80 further comprises a substantially planar central section 86. This central section 86 is provided not only as part of the supporting frame, but also to support baffle 90 and lens 95. In this embodiment, lens 95 is a plastic lens, although it will be apparent to the skilled person that a lens made of other transparent materials will be appropriate. Baffle 90 is provided to direct the light cast by the light source, and avoid glare when viewing the light fixture 200 from the side. The lens 95 may be attached to central support piece 80 as shown in this embodiment, or alternatively may be attached directly to the light source 30 or the mounting plate 40 as appropriate. As baffle 95 is suspended from the support piece 80, baffle 95 can be provided in any suitable material, such as silicone, plastic or other thermally insulating materials, or may be provided in thermally conductive materials such as aluminium or other metals without affecting the operation of the cooling circuit 100.

The light fixture 200 is suspended in a room space by way of suspending means 65, which are attached to suspension cables 66. In this embodiment, two suspending means 65 are provided, connected to the heat pipes 10. Due to the lightweight nature of the fins 20 and support frame, the heat pipes 10 are sufficiently strong to support the weight of the light fixture 200. Of course, the support means may alternatively connect to the fins 20 or the support frame.

In this embodiment, the driving electronics (not shown) for the light source 30 are external to the light fixture 200. Electrical current is provided by wires (not shown) which may be attached to, or form part of, suspension cables 66. Alternatively the wires may be separate from the suspension cables 66. The driving electronics may be mounted on, or recessed into, the ceiling above the light fixture 200, or may be remote from the light fixture entirely.

As the light fixture 200 is suspended within the room space, with the cooling circuit 100 exposed, air is free to flow between the fins. This enables efficient convection around the fins 20, maximising the transfer of heat from the cooling circuit 100 to the air mass of the space in which the light fixture 200 is suspended. Furthermore, convection is aided by orienting the fins 20 vertically, so that air can rise through the fin array as it is heated. The spacing between the fins 20 should be small enough to ensure that a sufficient number of fins 20 can be disposed along the length of the heat pipes 10, but not so small that the air-flow is encumbered and the dissipation of heat from each fin by convection reduced. In other words, increased surface area from more densely pack fins must be balanced against acceptable air resistance through the fin array. This air resistance depends on the length of the convection path through the fins. Preferably, for fins 20 of 4.5 cm height, a fin spacing of between 0.3 and 1.4 cm (i.e., a fin spacing to fin height ratio between 1:13 and 1:3.2) provides sufficiently dense fin packing, but does not introduce excessive resistance to convective air flow. More particularly, and as shown in this embodiment, for fins 20 of height 4.5 cm, a spacing of 0.8 cm is particularly advantageous, i.e., the fin spacing to fin height ratio is around 1:5.5.

While this particular embodiment has been directed towards down-light fixtures, it will be apparent to one skilled in the art that other configurations are possible. For example, the light fixture 200 may be inverted, with or without baffle 90, to act as an up-light fixture. Also, while the light fixture 200 has been discussed in the context of interior lighting, the light fixture 200 could equally well be installed in exterior spaces.

Furthermore, while the present embodiment of the invention includes two arrays of fins 20, it will be apparent to one skilled in the art that other numbers of arrays may be used and in other configurations, depending on the thermal requirements on the cooling circuit 100 and the aesthetic considerations of the lighting fixture. For example the fin arrays may be positioned in different relative positions and orientations to each other—e.g. the fin arrays may be disposed on the same axis, as illustrated here, or the fin arrays may be parallel to each other or perpendicular to each other. Fin arrays of different relative positions may be combined in a light fixture depending on the cooling requirements and aesthetic considerations of the fixture. For example, fin arrays extending in either direction away from the light source on one longitudinal axis on which the light source lies may be combined with fin arrays disposed between them, parallel or perpendicular to the longitudinal axis so that the light source is surrounded by a bezel comprised of fins.

Furthermore, the configuration of any given array of fins may be different to that shown here, for example the fins 20 may be arranged perpendicular to a curved heat pipe 10 such that they are not parallel to each other, but instead form a swept curve.

The overall effect of the light fixture 200, and in particular cooling circuit 100, is that of a very low junction temperature at the light source 30.

The effect of the arrangement of the heat pipes 10 local to the light source 30, is to ensure that the thermal path between all LEDs in the LED array and the heat pipes is minimised. Furthermore, as thermally conductive material is kept to a minimum local to the light source 30, there is a minimum of thermal mass local to the light source 30. As a result, the thermal resistance between the light source 30 and heat pipes 10 is minimised, so as to optimise the transfer of heat away from the light source 30, via the heat pipes 10, to the fins 20, where the heat is dissipated into the surrounding air by convection.

As a result, even with an LED array producing in excess of 70 W of heat, junction temperatures as low as 45° C. can be achieved. While LED arrays of this type can tolerate junction temperatures of up to 85° C., the cooling circuit 100, as part of light fixture 200, offers a dramatically better operating environment for the LED array. This lower junction temperature greatly enhances operational lifetime of the LED array, and also its output efficiency and long-term colour characteristics.

The preferred embodiment described above is by way of example; the scope of the invention is defined in the appended claims, and modification to the example may be made within the scope of the claims.

The invention claimed is:

1. A lighting device comprising: a light source; a plurality of heat pipes thermally connected to the light source; heat exchangers thermally connected to the heat pipes; and a support frame that comprises: elongate members that connect to edges or corners of the heat exchangers, and a cross-supporting member connecting the elongate members and comprising a planar portion that covers portions of the heat pipes that correspond to the light source, wherein a structure formed of the support frame, the heat pipes, and the heat exchangers supports the light source, wherein the cross-supporting member comprises connectors which are adapted to correspond to and engage with the inward facing profile of the elongate members.

2. The lighting device of claim 1, wherein the lighting device is adapted such that thermal mass is minimised local to the light source and that the thermal path between the light source and the heat pipes is minimised.

3. The lighting device of claim 1, wherein the light source has a light emitting side and a thermally conducting side which is in thermal communication with the heat pipes; and the heat pipes are in substantial alignment with the areas of the thermally conducting side which correspond with the light emitting areas of the light emitting side.

4. The lighting device of claim 3, wherein the entirety of the areas of the thermally conducting side which correspond with the light emitting areas of the light emitting side are in alignment with the heat pipes.

5. The lighting device of claim 4, wherein the heat pipes form an array with each heat pipe in direct thermal contact with the adjacent heat pipe to form an area which is at least the same as the area encompassing the light emitting area of the light source.

6. The lighting device of claim 1, wherein the light source is only in thermal communication with the heat exchangers by the heat pipes.

7. The lighting device of claim 1, wherein the heat pipes are adapted to provide a substantially planar mounting surface.

8. The lighting device of claim 7, wherein the heat pipes are bonded together and the bonded heat pipes are adapted to provide a continuous, substantially planar, mounting surface.

9. The lighting device of claim 1, wherein the heat pipes support the light source.

10. The lighting device of claim 1, wherein the light source is located at one end of the heat pipes.

11. The lighting device of claim 1, wherein the lighting device further comprises a thermally conducting mounting plate which connects the light source to the heat pipes.

12. The lighting device of claim 11, wherein the heat exchangers are formed of a different material from that of the mounting plate.

13. The lighting device of claim 1, wherein the heat exchangers comprise a plurality of substantially planar fins.

14. The lighting device of claim 13, wherein each fin comprises an engagement device, engageable with a corresponding engagement device on an adjacent fin.

15. The lighting device of claim 14, wherein the engagement device is a tab which is adapted to receive, and engage with, the tab of an adjacent fin.

16. The lighting device of claim 15, wherein the tab comprises an edge profile engageable with a corresponding edge profile on the tab of the adjacent fin.

17. The lighting device of claim 14, wherein the engagement device is disposed on at least one corner of each fin.

18. The lighting device of claim 14, wherein the engagement device is further adapted to connect to said structure.

19. The lighting device of claim 13, wherein the ratio of the spacing between fins to the height of the fins is between 1:13 and 1:3.2.

20. The lighting device of claim 19, wherein the ratio of the spacing between fins to the height of the fins is around 1:5.5.

21. The lighting device of claim 19, wherein the height of the fins is around 4.5 cm.

22. The lighting device of claim 1, wherein the lighting device further comprises a lens to direct the light from the light source, and wherein the support frame supports the lens.

23. The lighting device of claim 1, wherein the lighting device further comprises a baffle to direct the light from the light source, and wherein the support frame supports the baffle.

24. The lighting device of claim 1, wherein the elongate members are adapted to engage with corresponding tabs provided on the heat exchangers.

25. The lighting device of claim 1, wherein at least some of the heat pipes bend away from the axis along which they initially extend from the light source and bend back towards the axis along which they initially extend, such that they extend through the heat exchangers parallel to each other and parallel to the axis along which they initially extend.

26. The lighting device of claim 1, wherein the heat exchangers are formed of a different material from that of the heat pipes.

27. The lighting device of claim 1, wherein the lighting device is adapted to be suspended in a space, with the heat exchangers exposed to the air of the space in which the lighting device is suspended.

28. The lighting device of claim 27, wherein the lighting device comprises supports adapted to connect to cables from which the lighting device is suspended, wherein the supports are attached to one of the heat pipes and the heat exchangers.

* * * * *